US005868287A

United States Patent [19]

Kurokawa et al.

[11] Patent Number: 5,868,287

[45] **Date of Patent: *Feb. 9, 1999**

[54] LIQUID DISPENSING CONTAINER USING PRESSURE OF LIQUID TO OPEN DISHARGE OPENING

[75] Inventors: Takumi Kurokawa, Kitami; Hideyuki Usami, Soka; Kenichi Kumamoto, Koshigaya, all of Japan

[73] Assignee: Pentel Kabushiki Kaisha, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 696,933

[22] PCT Filed: Dec. 15, 1995

[86] PCT No.: PCT/JP95/02580

§ 371 Date: Aug. 21, 1996

§ 102(e) Date: Aug. 21, 1996

[87] PCT Pub. No.: WO96/19389

PCT Pub. Date: Jun. 27, 1996

[30] Foreign Application Priority Data

| | | | |
|---|---|---|---|
| Dec. 22, 1994 | [JP] | Japan | 6-335982 |
| Jan. 27, 1995 | [JP] | Japan | 7-31479 |
| Nov. 9, 1995 | [JP] | Japan | 7-316027 |

[51] Int. Cl.[6] ..... B67D 5/40

[52] U.S. Cl. ..... 222/380; 222/494

[58] Field of Search ..... 222/494, 105, 222/480, 391, 321.7, 383.3, 380

[56] References Cited

U.S. PATENT DOCUMENTS

| | | | |
|---|---|---|---|
| 2,792,149 | 5/1957 | Lutz | 222/494 |
| 4,179,051 | 12/1979 | Thomas | 222/494 |
| 5,154,328 | 10/1992 | Gueret | 222/380 |

FOREIGN PATENT DOCUMENTS

| | | |
|---|---|---|
| 49-12175 | 2/1974 | Japan . |
| 60-8268 | 1/1985 | Japan . |
| 60-188151 | 12/1985 | Japan . |
| 62-159357 | 10/1987 | Japan . |
| 4-3958 | 1/1992 | Japan . |
| 4-38960 | 4/1992 | Japan . |
| 4102254 | 9/1992 | Japan . |

*Primary Examiner*—Philippe Derakshani
*Attorney, Agent, or Firm*—Adams & Wilks

[57] ABSTRACT

In a liquid dispensing container for dispensing liquid from the liquid storage chamber through the dispensing port, an elastic member, which is normally closed but is opened by the pressure of liquid, is disposed at the dispensing port and the opened part of the elastic member opened by the liquid pressure is used as the dispensing port.

29 Claims, 14 Drawing Sheets

(PRIOR ART)

LIQUID DISPENSING CONTAINER USING PRESSURE OF LIQUID TO OPEN DISHARGE OPENING

TECHNICAL FIELD

The present invention relates to a liquid dispensing container for, for example, milky lotion, hand cream, foundation, shampoo, rinse, liquid dentifrice, mayonnaise, ketchup, paste and paint.

BACKGROUND ART

One example of a conventional liquid dispensing container that dispenses liquid contained in a liquid storage chamber is shown in FIG. 36.

In this conventional liquid dispensing container, a flexible container body 101 that can be pressed and deformed constitutes a liquid storage chamber 102 for storing liquids. At the top of the container body 101 is formed a dispensing opening 103 which has a threaded portion 104 at its outer periphery. A cap 105 is removably screwed on the threaded portion 104 to prevent drying of liquid and leakage of it when not in use.

In use, the cap 105 is taken off the container body 101 and the container body 101 is pressed to squeeze an appropriate amount of liquid from the liquid storage chamber 102 through the dispensing opening 103.

With the above conventional art, however, one may forget to put the cap 105 on the container after use. Moreover, during frequent use of the container, capping is troublesome for the user and he or she may leave it uncapped intentionally or carelessly for a long period of time, during which the surface of the liquid present in the dispensing opening 103 is exposed to the air and as a result it dries.

It is known that the air contains a variety of substances that may adversely affect human health, such as bacteria and dust. These substances, when they become mixed in the liquid, contaminate the liquid and in some cases produce mold and discoloration, making it very unsanitary. When such unsanitary liquid is a cosmetic or food it causes undesirable results.

SUMMARY OF THE INVENTION

An object of this invention is to provide an improved liquid dispensing container that solves the above problems.

Another object of this invention is to provide a novel liquid dispensing container that can prevent air or external foreign substance from entering the dispensing port and the interior of the container body, prevent the liquid from drying, and keep the liquid sanitary.

In the liquid dispensing container according to the first mode of this invention, which dispenses liquid from the liquid storage chamber through the dispensing port an elastic member that normally closes the dispensing port but opens it by the presence of liquid, is disposed at the dispensing port, and the opened part of the elastic member that is opened by the liquid pressure is made to function as the dispensing port.

In the liquid dispensing container according to the second mode of this invention, which dispenses liquid from the liquid storage chamber through the dispensing port of a nozzle, an elastic thin plate member is so fixed to the dispensing port as to be surrounded by the nozzle body, and a nonfixed part of the thin plate member is made to serve as the dispensing port.

In the liquid dispensing container according to the third mode of this invention, which dispenses liquid from the liquid storage chamber through the dispensing port, a filmlike member is fixed to the dispensing port with one part of the filmlike member unfixed, and the unfixed part of the filmlike member is made to function as the dispensing port.

In the liquid dispensing container according to the fourth mode of this invention, which dispenses liquid from the liquid storage chamber through the dispensing port of a nozzle, an elastic member is so fixed to the dispensing port as to be surrounded by the nozzle body, the elastic member forms a liquid passage that is normally closed, and the front end of portion of the liquid passage serves as the dispensing port.

PREFERRED MODES OF THE INVENTION

Figure 1:
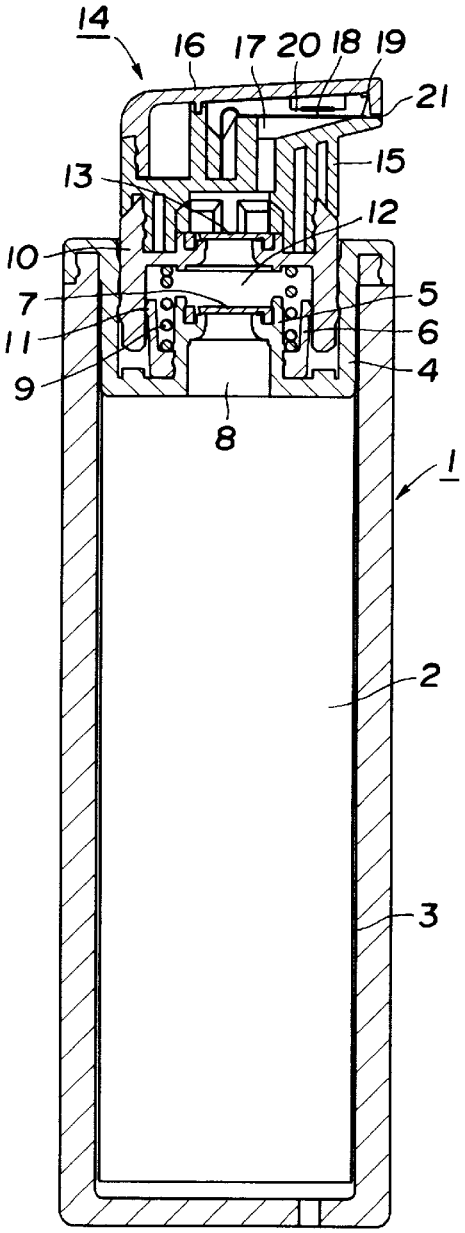
FIG. 1 is a vertical cross section of one mode of this invention.
Figure 2:
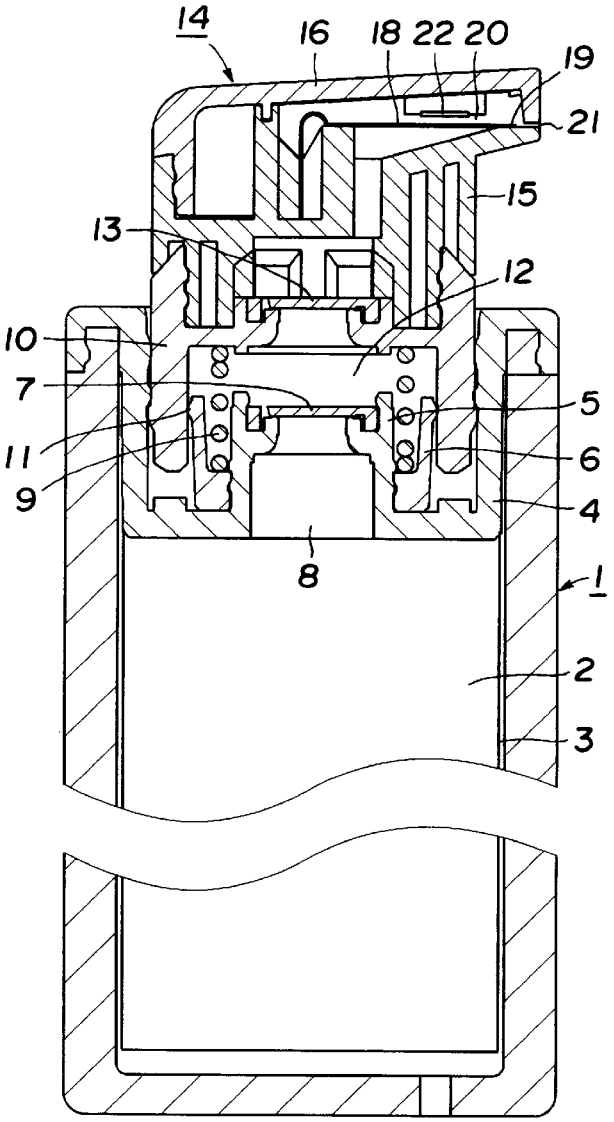
FIG. 2 is an enlarged vertical cross section of an essential portion of FIG. 1.
Figure 3:
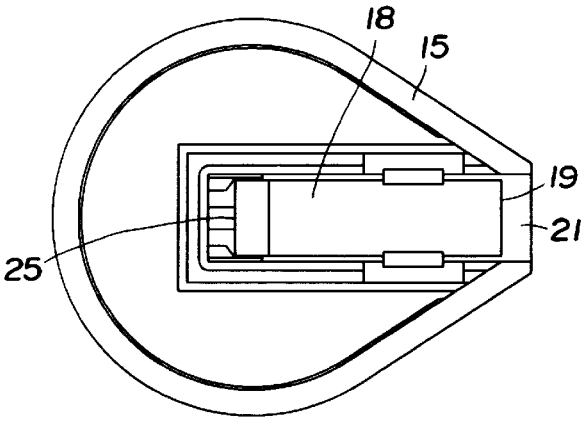
FIG. 3 is a plan view of FIG. 1 with a head cap removed.

Now, a liquid dispensing container as the first mode of this invention will be described with reference to the accompanying drawings.

A container body 1 accommodates a soft bag 3 therein which forms a liquid chamber (liquid storage chamber) 2. While it is possible to use the interior of the container body 1 directly as the liquid chamber 2, the use of the soft bag 3 is advantageous because as the liquid contained is dispensed, the soft bag 3 contracts easily preventing the outer air from becoming mixed in. The soft bag 3 is attached, through a heat seal for preventing leakage, to a circumferential surface below an opening member 4 attached to the opening of the container body 1. The opening member 4 has a piston 5 on the inner side. Although the piston 5 shown has a separate piston body 6 secured thereto to exhibit an appropriate degree of elasticity and ensure a large opening, they may be formed in one piece. The piston 5 has a valve 7 that can open upwardly in the drawing. The valve 7 forms an exit for the liquid through an inner hole 8 communicating with the liquid chamber 2.

A cylinder 10 biased upwardly by an elastic member 9 in the form of a spiral spring fitted liquid-tightly and slidably in the piston 5. A resilient annular portion 11 provided to the outer circumferential wall of the piston body 6 is a sealing sliding portion for the inner circumferential wall of an inner hole 12 of the cylinder 10. The cylinder 10 has a valve 13 that can be opened upwardly in the drawing like the valve 7. The valve 13 forms an exit for the liquid that came out of the valve 7 into the inner hole 12.

At the top of the cylinder 10 is mounted a nozzle body 14, which, as shown in the figure, includes a nozzle member 15 with a passage for the liquid coming out of the valve 13, a crown 16 formed either separately from or integrally with the nozzle member 15, and a thin plate member 18 fixed in the middle of a liquid passage 17 of the nozzle member 15. The thin plate member 18 normally closes the liquid passage 17 and is fixed at the rear part thereof. In use, the thin plate member 18 is elastically deformed, and the portion thereof at and near the front end of the liquid passage 17 serves as a dispensing portion 19. Under the crown 16 is formed an escape space 20 that allows the thin plate member 18 to be elastically deformed. The thin plate member 18 extends close to a nozzle opening 21 at the end of the liquid passage of the nozzle member 15 but is not exposed from the nozzle opening 21. This arrangement is contrived considering variations in the size of the thin plate members 18 due to forming and to ensure that the thin plate member 18 is prevented from being touched directly by fingers.

Figure 5:
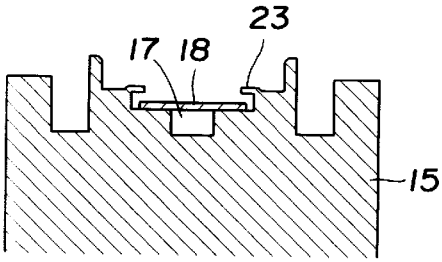
FIG. 5 is an essential-part cross section showing a modified example of a limiting projection.
Figure 9:
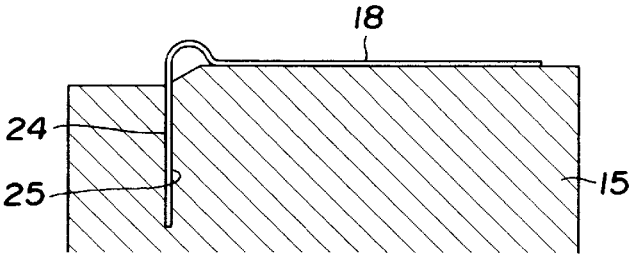
FIG. 9 is a vertical cross section showing how the thin plate member is mounted.

Under the crown 16 is formed a limiting projection 22 that prevents excessive deflection of the thin plate member 18 in the escape space 20. As another structure to prevent the excess deflection of the thin plate member 18, it may be possible, as shown in FIG. 5, to form limiting projection 23 at an upper part of the side wall portion of the liquid passage 17 and, after fixing the thin plate member 18, bend the projections inwardly. The prevention of excessive deflection of the thin plate member 18 ensures that the thin plate member 18 does not plastically deform and can return to its original shape with elapse of time. It also prevents the liquid from being dispensed in an excessive amount during use.

Next, some examples of thin plate member will be explained. The thin plate member 18 may be made of such a metal material as stainless steel, carbon steel, or copper alloy (phosphor bronze), a material which is prepared by coating the metal material with polyamide, polyvinyl chloride, polyethylene or polyurethane, or such a resin molded material as POM, ABS, PP, PET or PE. Appropriate selection can be made depending on the kind of liquid used. Coating of the metal material with resin improves the adhesion (sealing performance) and corrosion resistance.

Figure 7:
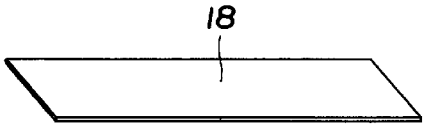
FIG. 7 is a perspective view of another example of the thin plate member.
Figure 4:
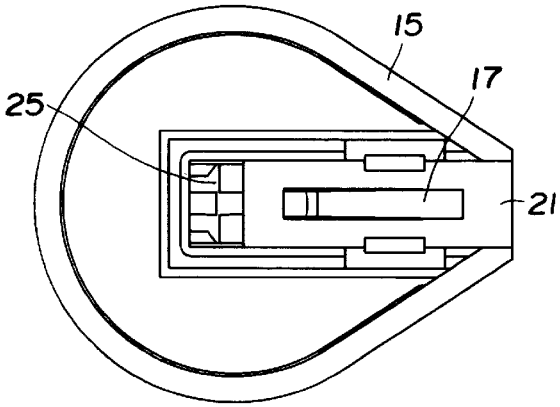
FIG. 4 is a plan view of FIG. 3 with a thin plate member removed.
Figure 8:
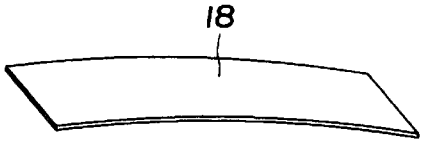
FIG. 8 is a perspective view of still another example of the thin plate member.
Figure 10:
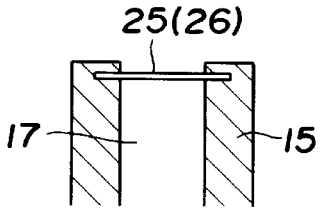
FIG. 10 is a vertical cross section showing another example of how the thin plate member is mounted.
Figure 11:
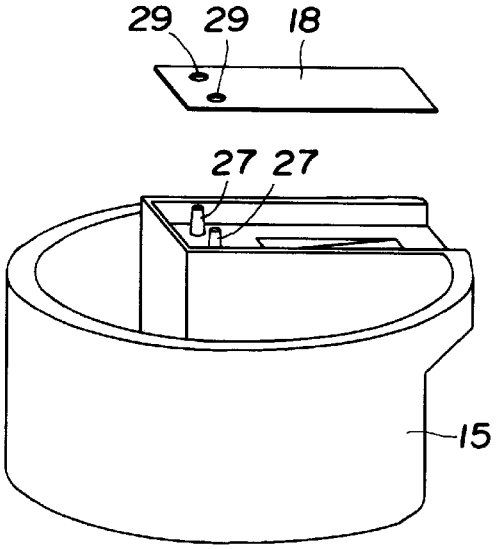
FIG. 11 is a perspective view showing still another example of how the thin plate member is mounted.
Figure 12:
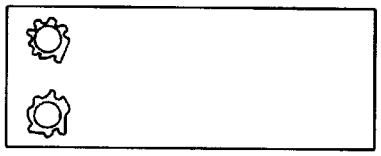
FIG. 12 is an essential-part plan view showing the thin plate member of FIG. 11 mounted in place.

Next, how the thin plate member 18 is fixed will be explained. As shown in FIG. 1 and FIGS. 2, 6 and 9, which are enlarged views of FIG. 1, the rear part of the thin plate member 18 may be curved and the rear portion 24 pressed into a fixing vertical groove 25 formed in the nozzle member 15. Alternatively, as shown in FIG. 7 and 8, it is possible to press a flat, thin plate member 18 or a slightly curved thin plate member 18 into the fixing vertical groove 25 (see FIG. 10). There are other various methods, and in another method, as shown in FIG. 11, projections 27 are formed on the nozzle member 15, fixing holes 29 are bored in the rear portion of the thin plate member 18, the projections 27 are fitted in the fixing holes, and the projections 27 are fused to the plate member 18 (see FIG. 12).

Figure 6:
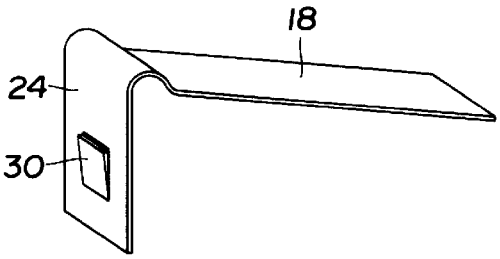
FIG. 6 is a perspective view of the thin plate member.

Reference numeral 30, in the thin plate member 18 of FIG. 6, denotes a check projection which prevents the thin plate member 18 from coming off the fixing vertical grooves 25. This is not needed when the fixing force is sufficient.

Now, an example of use will be described. When the crown 16 is pushed down, the cylinder 10 is slid downward in the figure of the drawing against the resilient force of the elastic member 9. At this time, the valve 13 is opened allowing the liquid to flow from the inner hole 12 of the cylinder 10 out into the liquid passage in the nozzle member 15, increasing the inner pressure and deforming the thin plate member 18 to open the dispensing portion 19. This establishes the liquid passage, then allowing the liquid to flow out of the nozzle opening 21 formed in the nozzle member 15. When the crown 16 is released from the depressing force, the thin plate member 18 returns to the original position closing the liquid passage again. At the same time, the cylinder 10 is slid upward (and returns to its original position) by the resilient force of the elastic member 9. At this time the valve 7 is opened allowing the liquid to flow from the inner hole 8 of the piston 5 out into the inner hole 12 of the cylinder 10, to prepare the next dispensing.

Figure 13:
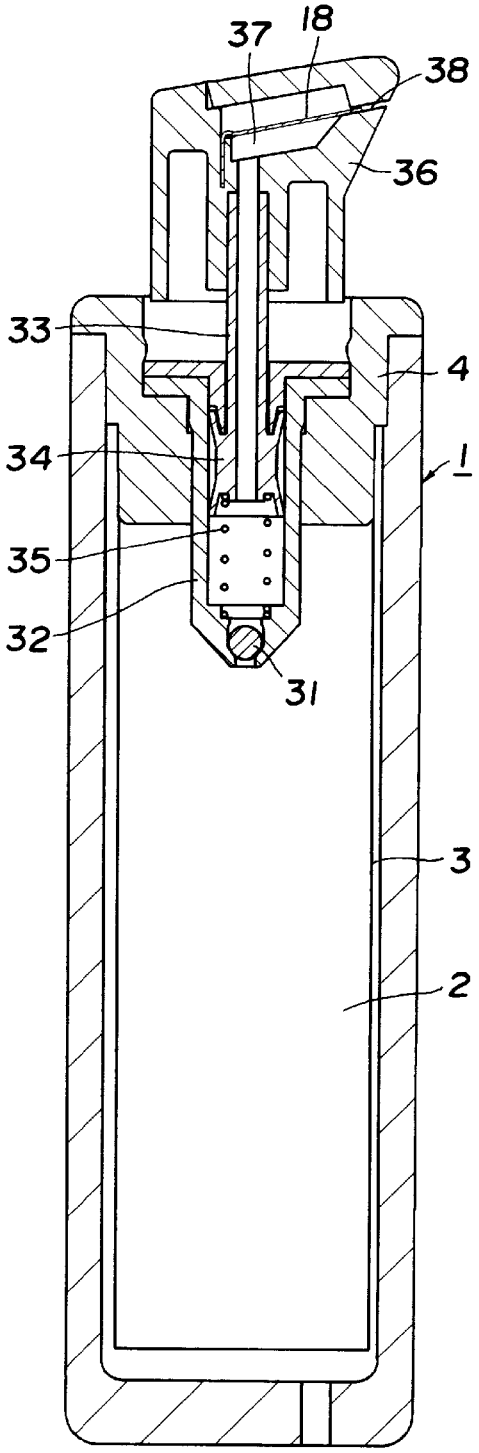
FIG. 13 is a vertical cross section showing another example of this invention.

In addition to the above arrangement, various other configurations may be adopted. For example, the valve 7 and the valve 13 need not be identical in position and shape with those shown. An example shown in FIG. 13 uses a ball type valve mechanism, in which the opening member 4 secured to the container body 1 is fitted with a soft bag 3 in a manner similar to the preceding example. A cylinder 32 having a ball valve 31 is secured to the opening member 4, and in the cylinder 32 a piston body 34 provided with a cylinder portion 33 is slidably provided, biased by an elastic member 35 such as a coil spring. The piston body 34 is provided at its top with a nozzle member 36 (in this example, the crown is integrally formed with the nozzle member) similar to the one in the previous example. The liquid passage 37 is fixedly provided with the thin plate member 18.

Next, the operation of this example will be explained. When the nozzle member 36 is depressed, the piston body 34 is slid downwardly in the figure against the resilient force of the elastic member 35, closing the ball valve 31 and compressing the liquid in the cylinder 32, which in turn deforms the thin plate member 18 to form the liquid passage allowing the liquid to be discharged out of the nozzle opening 38. When the nozzle member 36 is released from the depressing force, the resilient force of the elastic member 35 causes the piston body 34 to slide upward (and return to the original position). At this time, the ball valve 31 is opened (the ball moves up) allowing the liquid in the liquid chamber 2 to move into the cylinder 32. Because at this time the liquid passage is closed by the thin plate member 18, there is no possibility that air enters the liquid chamber through the liquid passage.

Figure 14:
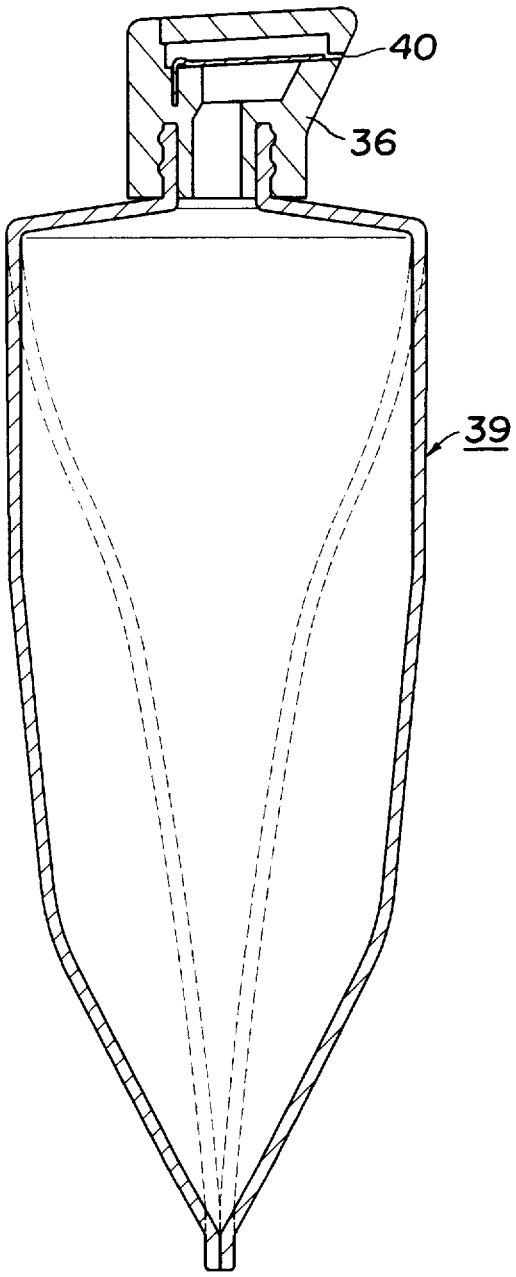
FIG. 14 is a vertical cross section showing a further example of this invention.

In the case of an example shown in FIG. 14, liquid is dispensed from the nozzle opening 40 by directly pressing the container body 39 with a person's fingers. The dashed line in the figure show the state of the container body when the container body is depressed or the amount of liquid in the container body decreases. The container body 39 itself forms the liquid chamber and is made of a soft flexible material such as silicone rubber, SBR, NBR, butyl rubber, elastomer, or polyethylene. The container body 39 has a constricted portion at the top, on which is screwed a nozzle member 36 similar to the one used in the preceding examples. The nozzle member 36 may be attached by another fixing means that employ recess-and-projection engagement, or by bonding. Compared with the two previous examples, this one, though not capable of dispensing a fixed amount of liquid, has advantages that the amount of liquid squeezed out can be changed according to the user's preference and the example can be manufactured inexpensively because of omission of the valve mechanism for dispensing a constant amount of liquid.

Figure 15:
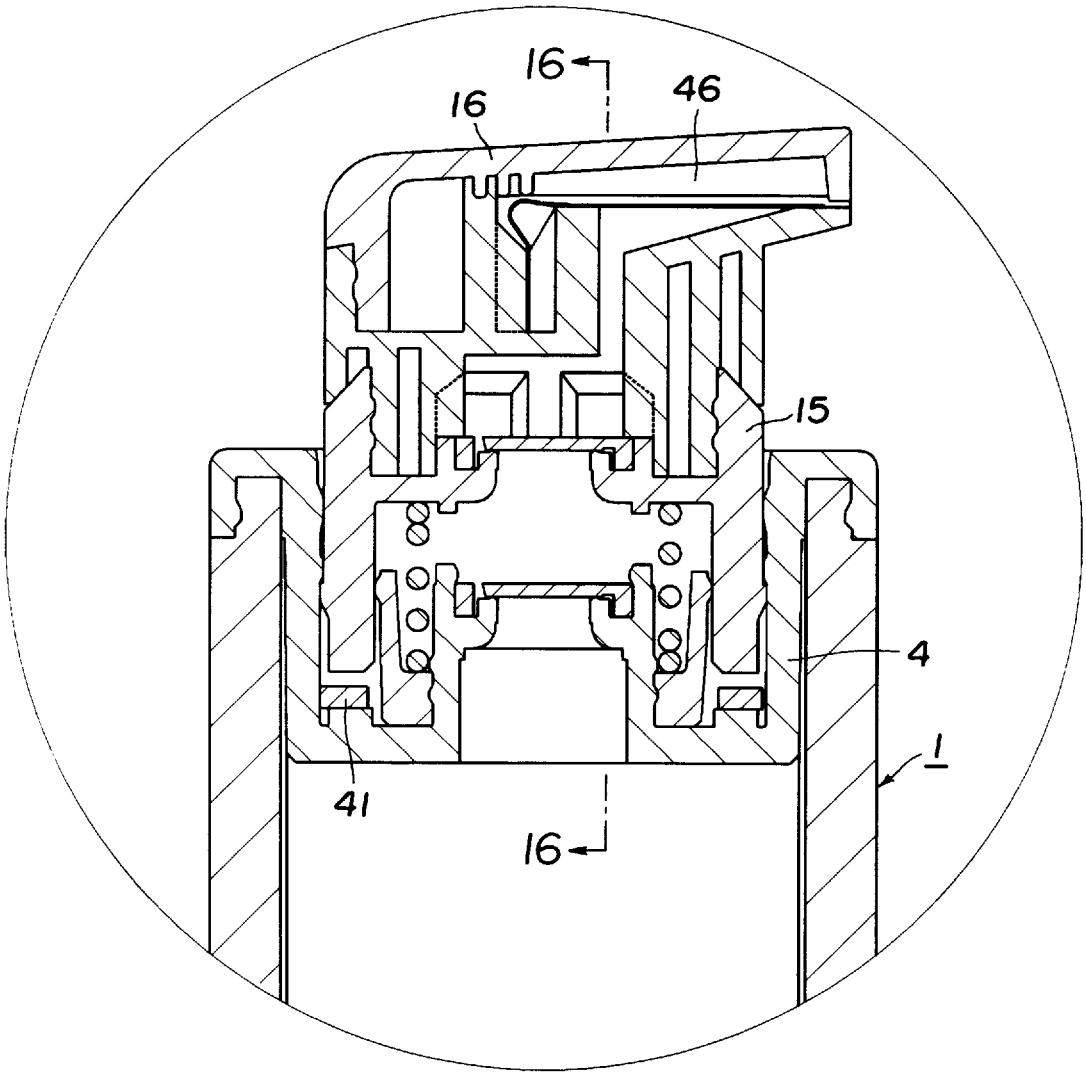
FIG. 15 is a vertical cross section showing a further example of this invention.
Figure 16:
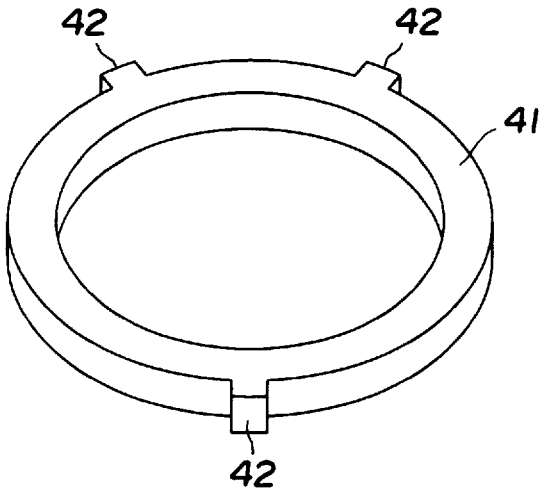
FIG. 16 is a perspective view showing an essential portion of FIG. 15.
Figure 16:
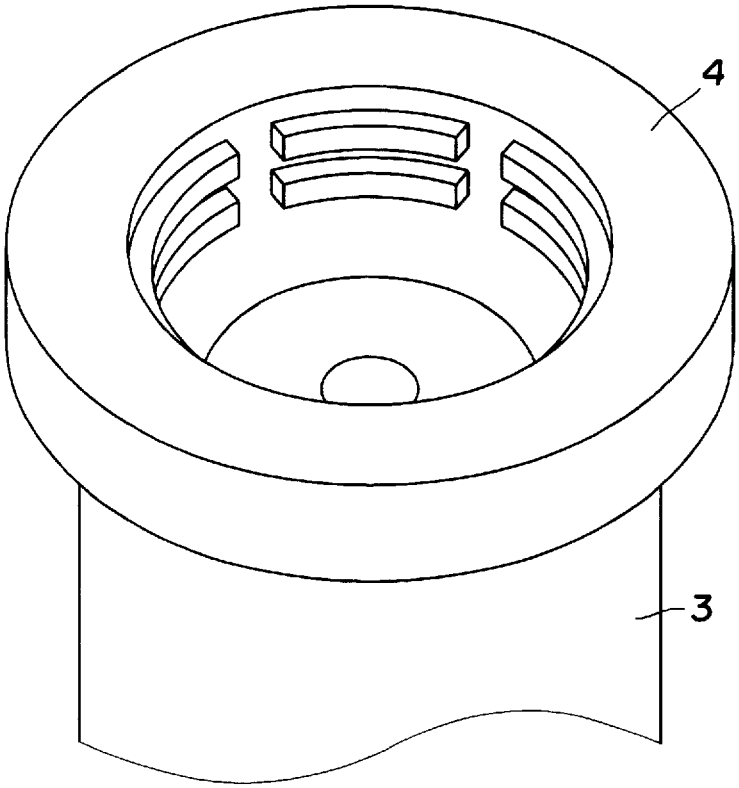
Figure 17:
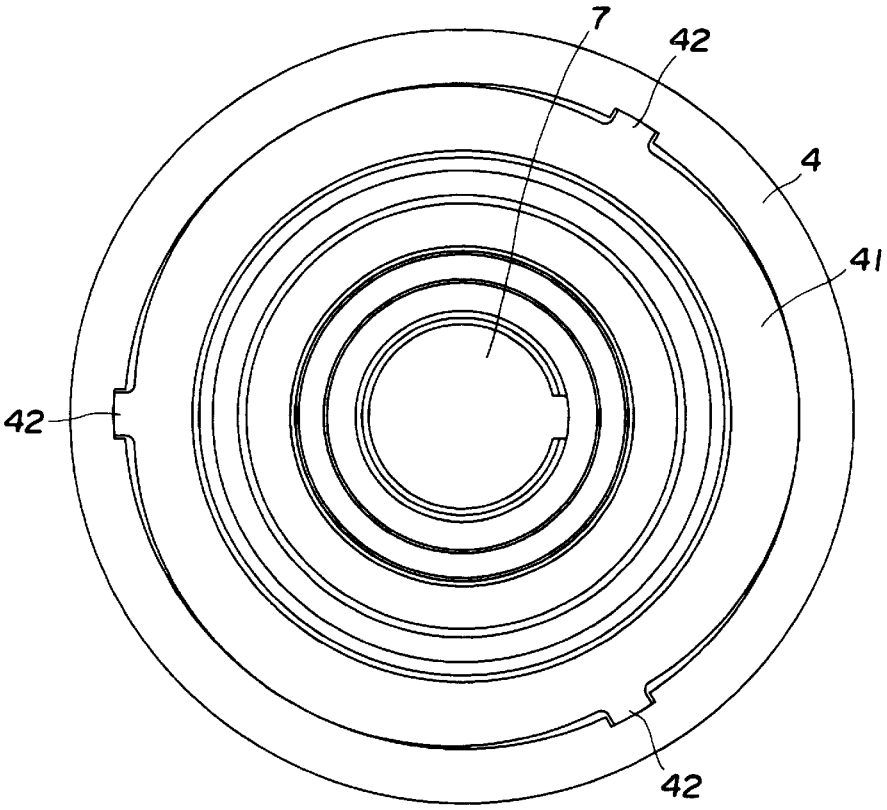
FIG. 17 is a plan view of FIG. 15 with the nozzle body removed.

An example shown in FIGS. 15 to 17 is a modification of the piston type container described above, which has a spacer 41 disposed below the lower end of the periphery of the nozzle member 15 inside the opening member 4. By changing the thickness of the spacer 41, the amount of liquid discharged out can be adjusted easily and with little additional cost. The spacer 41 has a plurality of ribs 42 formed at its periphery at regular intervals, so that the spacer 41 is press-fitted inside the inner circumferential wall of the opening member 4 in a somewhat deformed state (see FIG. 17).

Figure 18:
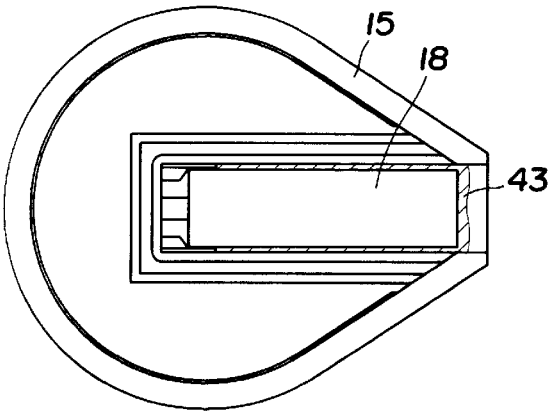
FIG. 18 is a plan view of a further example of this invention.
Figure 19:
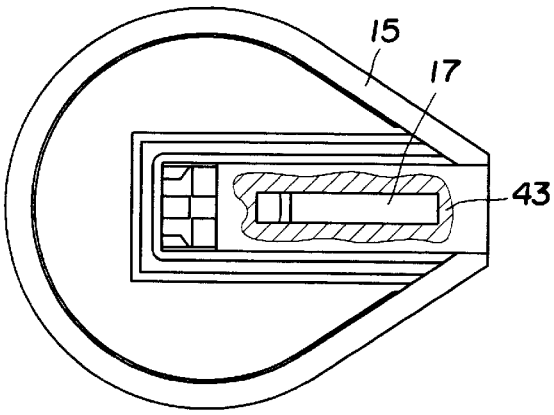
FIG. 19 is a plan view of FIG. 18 with the thin plate member removed.
Figure 20:
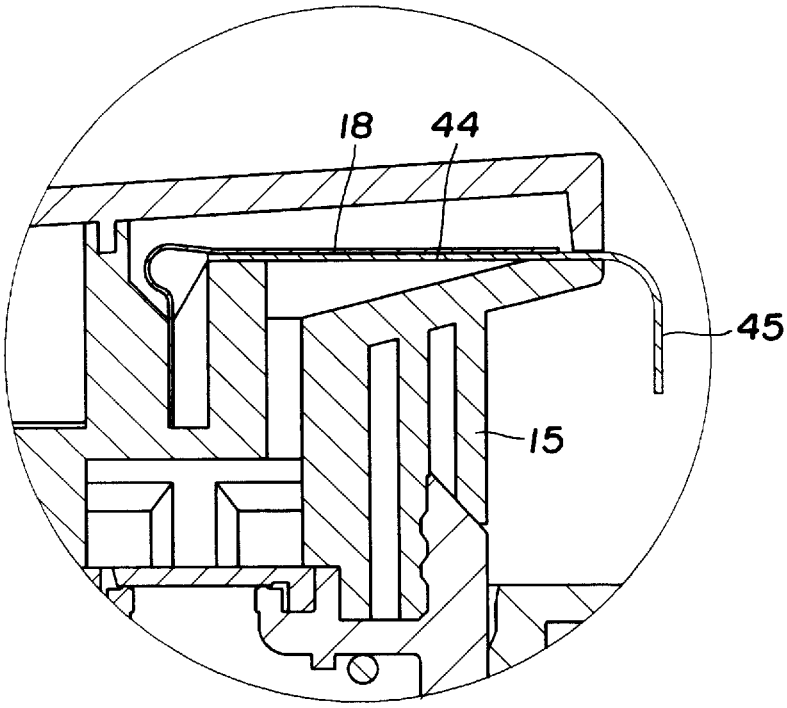
FIG. 20 is a cross section showing an essential portion of a further example of this invention.

In an example shown in FIG. 18 and 19, a liquid sealant 43 with a low volatility is applied to the contact surface between the nozzle member 15 and the thin plate member 18 to prevent ingress of air into the liquid storage chamber during the time the container is transported from the manufacture to a user. That is, even when the machining accuracy of the nozzle member 15 and the thin plate member 18 is high, there is a gap between them. The liquid sealant 43 is used to close this gap. After a user obtains the product, the liquid is present between the nozzle member 15 and the thin plate member 18 and therefore prevents air from entering the container. FIG. 20 shows a modification of the liquid sealant 43, which is an adhesive tape 44 interposed between the nozzle member 15 and the thin plate member 18. This adhesive tape 44 prevents ingress of air into the liquid storage chamber. Before use, the end 45 of the adhesive tape 44 is pulled and removed from the nozzle member 15 so that the liquid can be dispensed.

Figure 21:
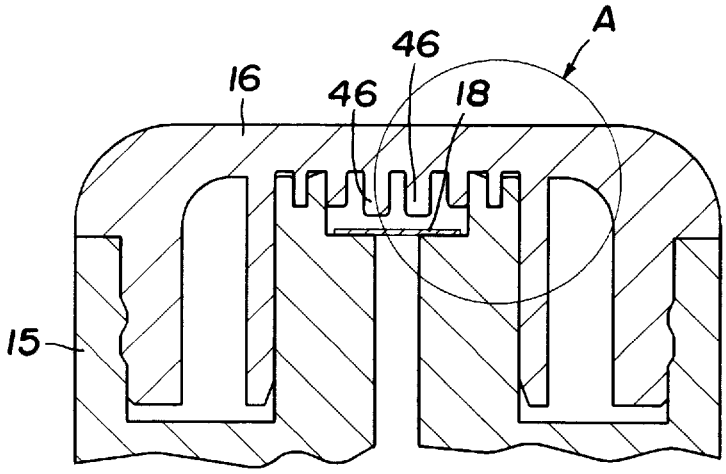
FIG. 21 is a cross section showing an essential portion of a further example of this invention.
Figure 22:
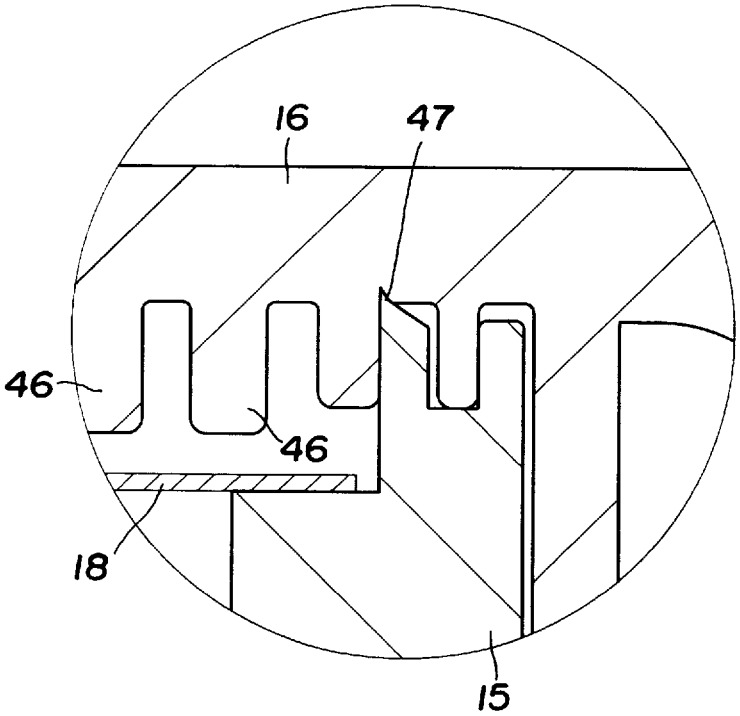
FIG. 22 is an enlarged view of the portion A of FIG. 21.

Further, in an example shown in FIG. 21 (lateral cross section of FIG. 15) and in FIG. 22 (enlarged cross section showing an essential portion of FIG. 21), to minimize the amount of liquid staying above the thin plate member 18, the underside of the crown 16 is provided with a plurality of projections 46; and to enhance the performance of sealing between the nozzle member 15 and the crown 16, a sharp edge portion 47 is formed in the nozzle member 15 and is forced to bite into the crown 16 while being slightly crushed.

Figure 23:
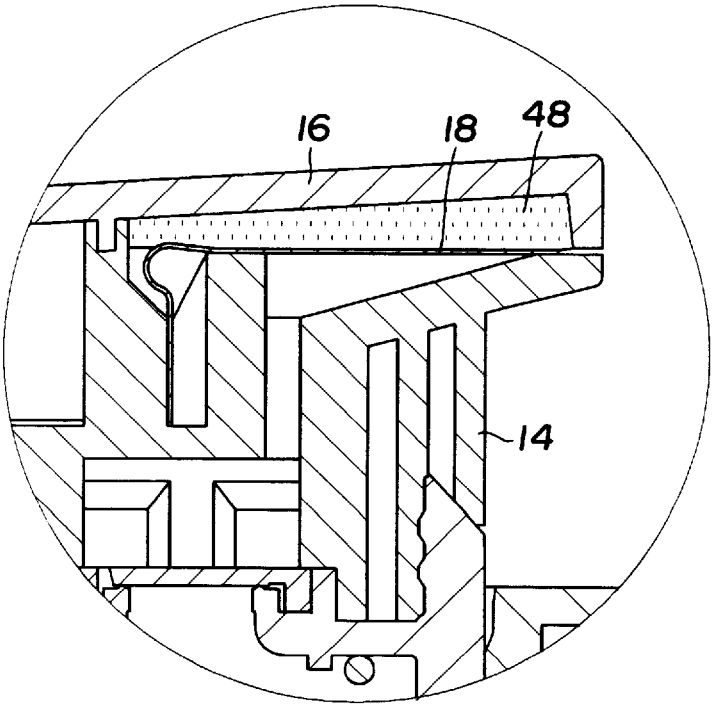
FIG. 23 is a cross section showing an essential portion of a further example of this invention.

The means for minimizing the amount of liquid remaining above the thin plate member 18 include the one shown in FIG. 23, in which an elastic member 48 such as sponge and foamed urethane is interposed between the crown 16 and the thin plate member 18.

Figure 24:
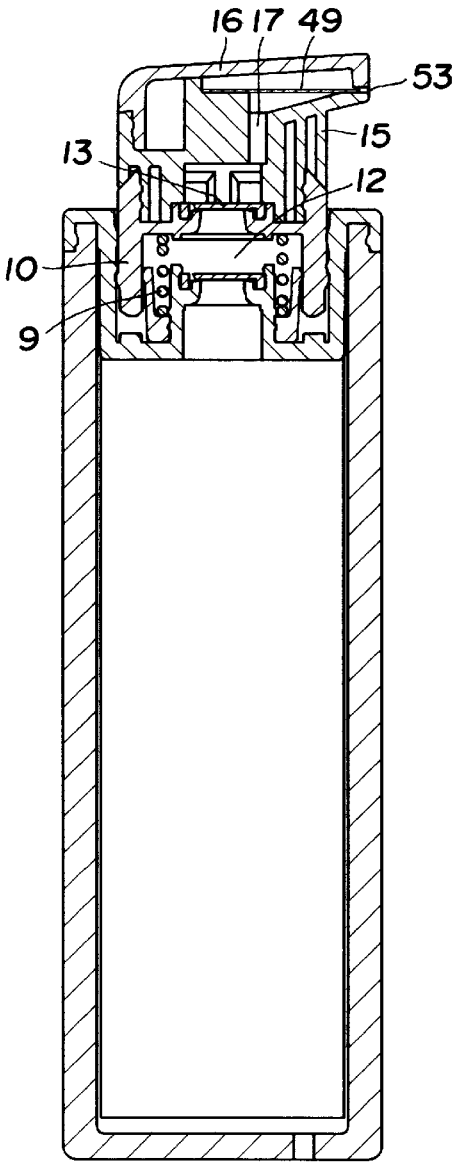
FIG. 24 is a vertical cross section showing the second mode in which this invention is embodied.
Figure 25:
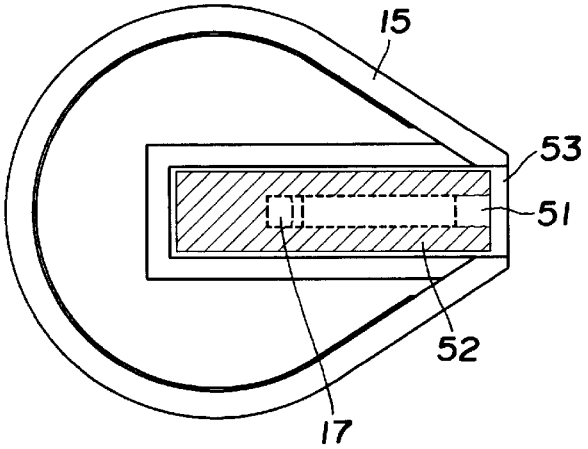
FIG. 25 is a plan view of FIG. 24 with the nozzle body removed.
Figure 26:
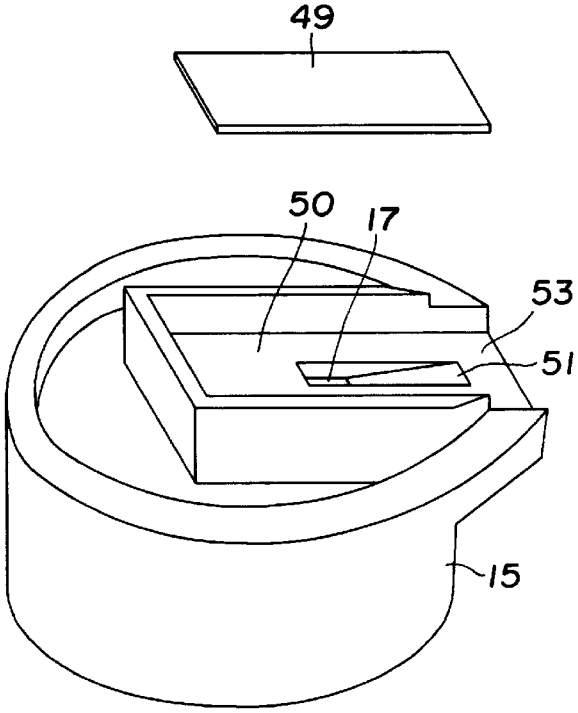
FIG. 26 is a perspective view showing how the filmlike member is mounted.

Next, an example of construction of the second mode of this invention will be described referring to FIGS. 24 to 26. Explanations about the portions similar to those of the first mode are omitted. Instead of the thin plate member 18 of the first mode, this mode fixes an elastically deformable filmlike member 49 to the dispensing port.

Though the filmlike member may be formed into a single layer structure of PET, polyethylene, polyvinyl chloride or nylon, a two-layer structure may be used in which polyethylene or polypropylene is bonded to the underside of the PET. It is also possible to employ a three-layer structure in which PET is joined to the upper side of an aluminum foil and polyethylene is joined to the underside, or in which PET is joined to the upper side of an aluminum foil and polypropylene to the underside. Filmlike members may include a vinylidene chloride-coated PET with polyethylene joined to the underside, a vinylidene chloride-coated PET with polypropylene joined to the underside, a silicon oxide-coated PET with polyethylene joined to the underside, a silicon oxide-coated PET with polypropylene joined to the underside, and a PET with its underside coated with hot-melt resin. Appropriate material may be selected from among these materials depending on the kind of liquid used.

Next, how the filmlike member 49 is fixed to the nozzle member 15 will be described. A simple method uses a bonding agent for fixing it. Depending on the kind of liquid, however, the bonding agent may mix with the liquid. Hence, thermal bonding is preferable in which the filmlike member 49 be put on a fixing surface 50 of the nozzle member 15 and subjected to heating or ultrasonic waves to join them together. It is noted that the dispensing port 51 for dispensing liquid is not bonded (fixed). A hatched portion 52 of FIGS. 25 shows a thermally bonded area (fixed part).

To enhance the firmness of the thermally bonded portion, the fused surface of the filmlike member 49 may be made of the same material as that of the nozzle member to which it is fixed. When a multiple layer structure, such as two or three-layer structure, is employed, it is preferable that a material with a low melting point be used on the underside.

Now, the operation will be explained. In FIG. 24, when the crown 16 is depressed, the cylinder 10 slides downwardly in the figure against the resilient force of the elastic member 9, opening the valve 13, which in turn allows the liquid to flow from the inner hole 12 of the cylinder 10 into the liquid passage in the nozzle member 15. The liquid flowing into the liquid passage increases the inner pressure and elastically deforms the filmlike member 49 to open the dispensing port 51, thus establishing the liquid passage, through which the liquid then flows out of a nozzle opening 53 formed in the nozzle body 14. When the crown 16 is released from the depressing force, the filmlike member 49 recovers to shut off the liquid passage again. At the same time, the resilient force of the elastic member body 9 forces the cylinder 10 to slide upward (and return to its original position). At this time, the valve 7 is opened allowing the liquid to move from the inner hole 8 of the piston 5 into the inner hole 12 of the cylinder 10, preparing the next dispensing.

Figure 27:
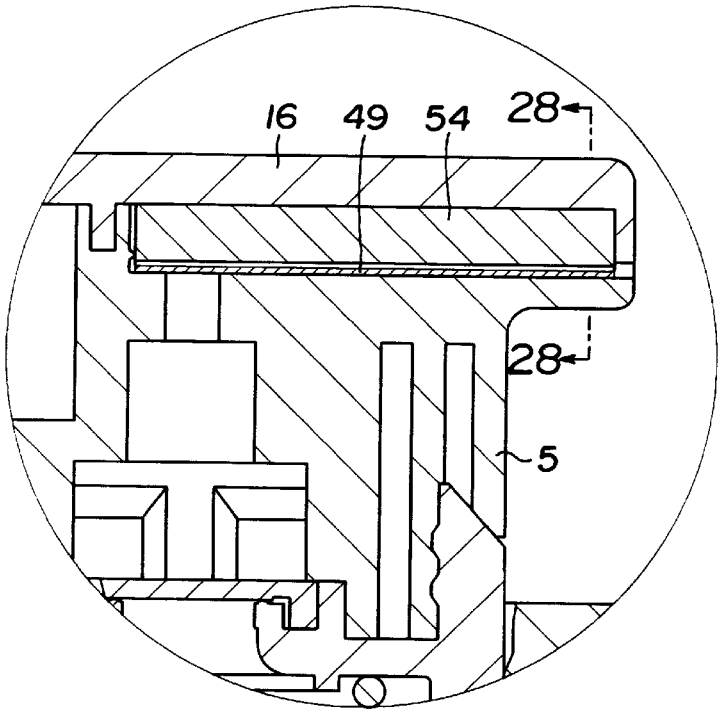
FIG. 27 is an essential-part vertical cross section showing a further example of the second mode.
Figure 28:
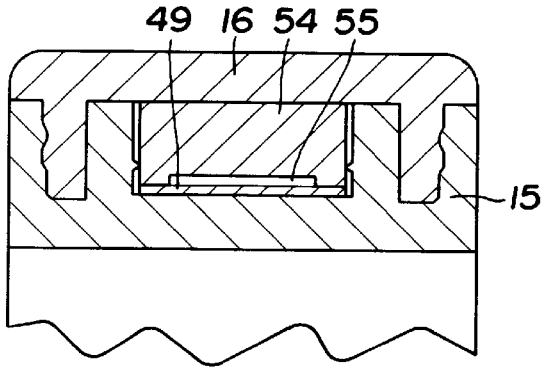
FIG. 28 is a cross section taken along the line 28—28 of FIG. 27.
Figure 29:
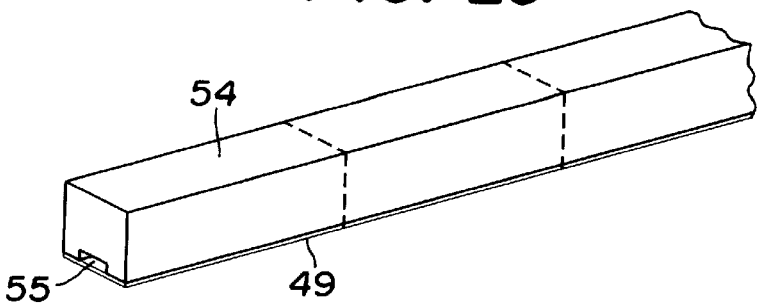
FIG. 29 is an essential-part vertical cross section showing a further mode of the second mode.

An example shown in FIGS. 27 to 29 is a modification of the second mode of this invention, adapted to facilitate its assembly. The filmlike member 49 is joined beforehand to a support member in the form of a rubber elastic body 54 with a U-shape cross section. The rubber elastic body 54 is pressed under pressure between the crown 16 and the nozzle member 15. This arrangement eliminates the fusing work in a narrow portion and thus improves its assembly performance. A recessed portion 55 of the rubber elastic body 54 is a space into which the bulged portion of the filmlike member 49 caused by the liquid discharge can escape.

To manufacture at a low cost the rubber elastic body 54 to which the filmlike member 49 is joined, the rubber elastic body 54 may be formed in a large length beforehand and then cut later (see FIG. 29). Because the elastic body can be cut to a desired length, it is possible to deal with a variety of containers depending on the use.

Next, the third mode of this invention will be described referring to FIGS. 30 to 33. Explanations of the constructions similar to those of the first mode will not be given. Instead of the thin plate member 18 used in the first mode, in this mode an elastically deformable a tube member 56 whose front end portion is formed as a dispensing port is used.

The tube member 56 is disposed between the crown 16 and the nozzle member 15. One end thereof is located close to and preferably inserted into the nozzle opening 21 of the nozzle body 14, and also serves as a dispensing port 57. The other end of the tube member 56 is fixed above the valve 13.

At the top of the nozzle member 15 is formed a retainer portion 58 that keeps the tube member 56 crushed at all times. The retainer portion 58 has an escape space 59 to allow the tube member 56 to be elastically deformed. The tube member 56, which extends as close to the end surface of the nozzle body 14 as possible, does not project from the end surface. This arrangement is contrived considering the variations in size caused by cutting and injection molding and to prevent the front end surface of the tube member 56 from being touched directly by fingers.

Next, some examples of the tube member will be explained below. The tube member may be formed of silicone rubber, nitrile rubber, acrylic rubber, fluororubber, natural rubber, chloroprene rubber, butyl rubber or neoprene rubber.

Figure 30:
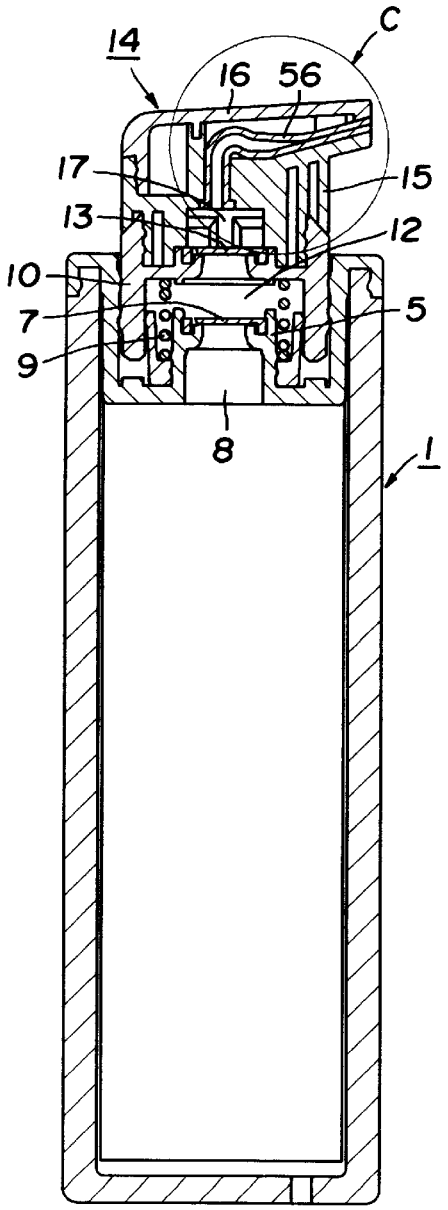
FIG. 30 is a vertical cross section showing a third mode of this invention.
Figure 31:
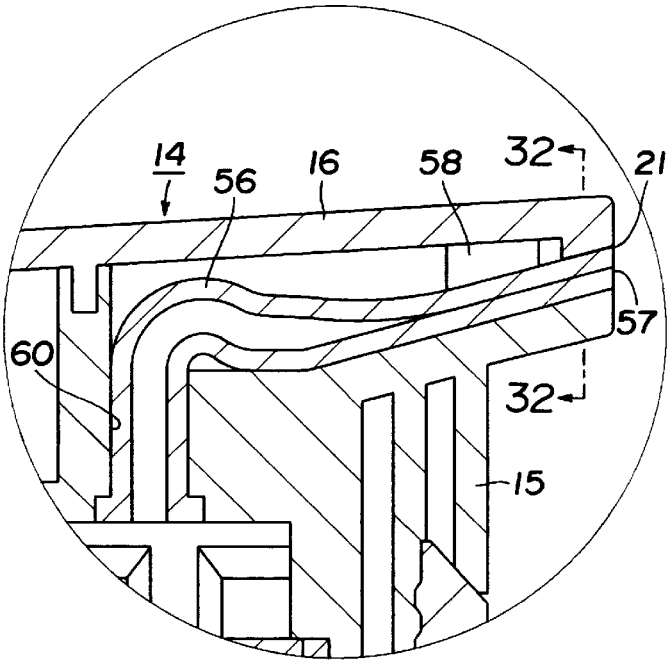
FIG. 31 is an enlarged cross section of the part C of FIG. 30.
Figure 32:
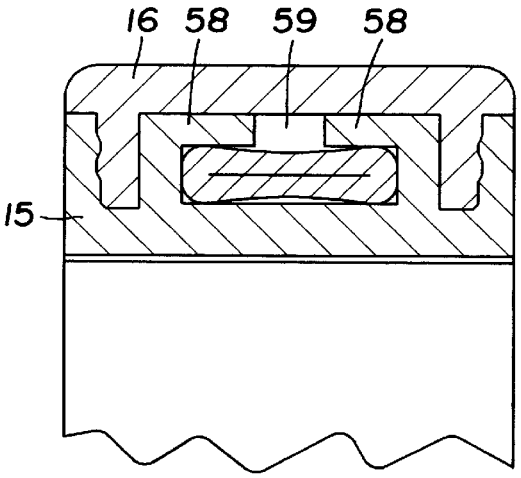
FIG. 32 is a cross section taken along the line 32—32 of FIG. 31.
Figure 33:
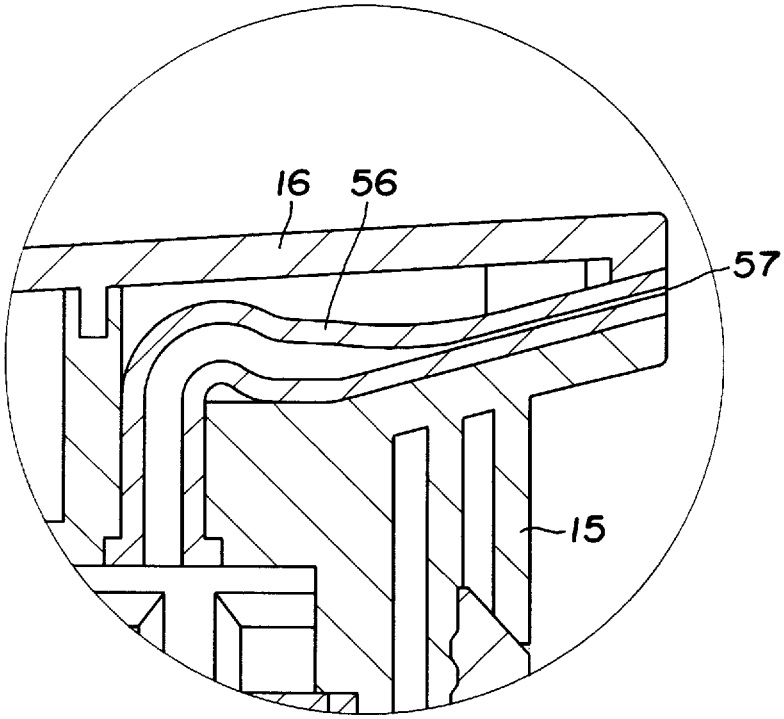
FIG. 33 is a vertical cross section of an essential part showing an example of the operation.

A method of fixing the tube member will be described in detail. As shown in FIG. 30 and in FIG. 31, which is an enlarged view of FIG. 30, one end of the tube member 56 is fitted under pressure into a vertical fixing hole 60 defined in the nozzle member 15. The vertical hole 60 is, of course, at a location where the liquid flows from the valve 13. Near the other end the tube member 56 is fixed by the retainer portion 58 formed in the nozzle member 15 so that it can be elastically deformed. The end of the tube member 56 is also held by the nozzle member 15 and the crown 16.

Next, the operation will be explained. When the crown 16 is depressed, the cylinder 10 slides downwardly in the figure against the resisting force of the elastic member 9, opening the valve 13 to allow the liquid to flow from the inner hole 12 of the cylinder 10 into the liquid passage 17 in the nozzle member 15. The liquid entering the liquid passage 17 increases the internal pressure, which in turn deforms and elastically expand the tube member 56 to open the dispensing port 57, thus forming the liquid passage over the full length of the tube member 56 (see FIG. 33). And, then, the liquid comes out of the nozzle opening 21. When the crown 16 is released from the depressing force, the tube member 56 recovers and collapses to shut off the dispensing port 57. At the same time, the resilient force of the elastic member 9 causes the cylinder 10 to slide upward in the figure (to return to its original position). At that time the valve 7 is opened allowing the liquid to flow from the inner hole 8 of the piston 5 into the inner hole 12 of the cylinder 10. Thus the next discharge is prepared.

Figure 34:
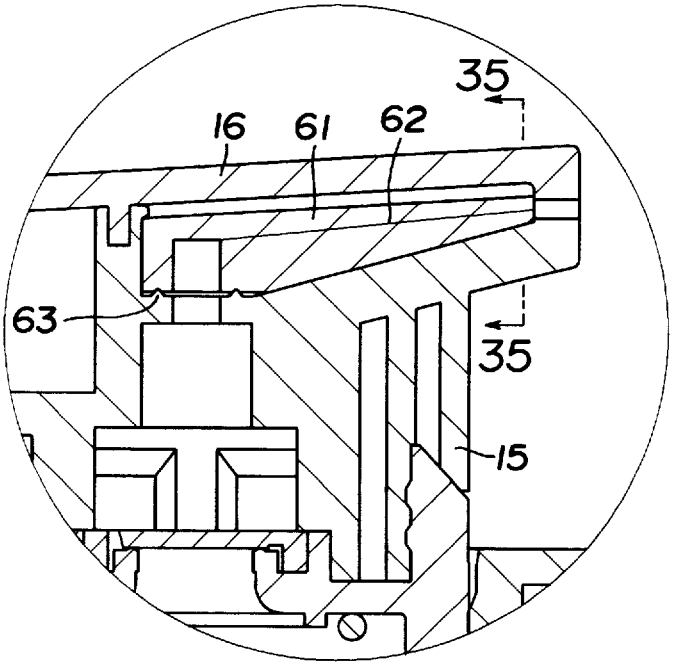
FIG. 34 is a vertical cross section showing another example of the third mode of this invention.
Figure 35:
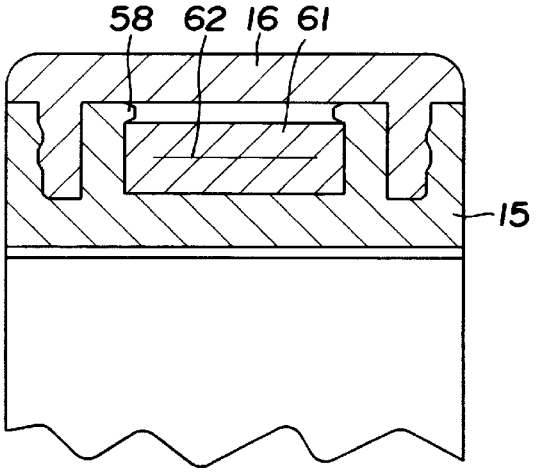
FIG. 35 is a cross section taken along the line 35—35 of FIG. 34.
Figure 36:
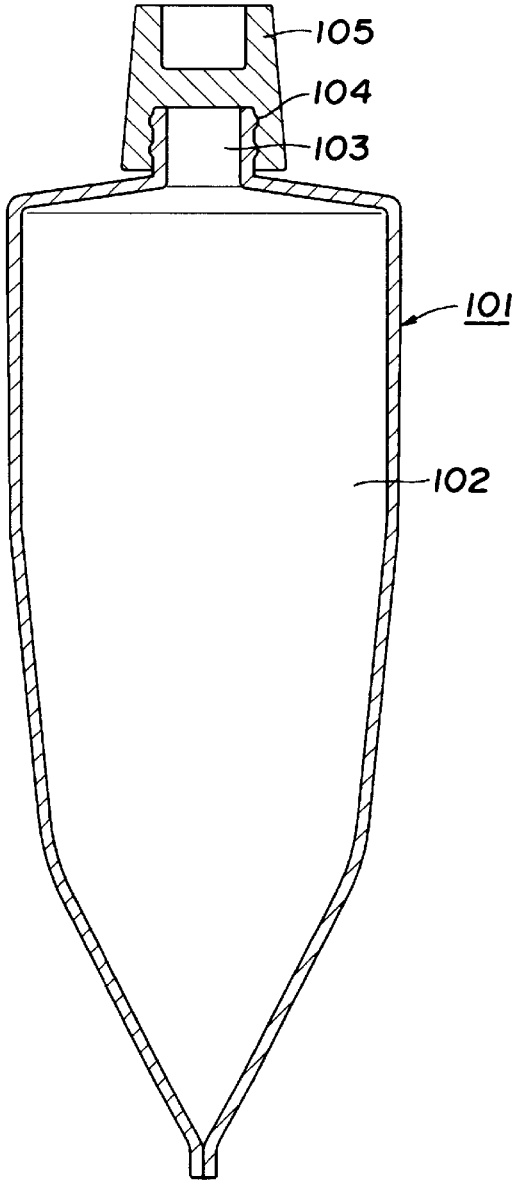
FIG. 36 is a vertical cross section of an example of the prior art.

The fourth mode, a modification in construction of the third mode, will be described referring to FIGS. 34 and 35. The tube member 56 in the preceding mode is replaced with an elastically deformable block member 61 made of such material as silicone. The block member 61 is securedly held by the retainer portion 58 formed on the top surface of the nozzle member 15. A slit 62 that serves as a liquid passage is defined in the block member 61. This slit 62 is opened by the pressure of the liquid and functions as a liquid passage or dispersing port. At a portion that is not only the contact surface between the nozzle member 15 and the block member 61 but also the liquid passage, a circular projection 63 is formed to prevent leakage. The circular projection 63 sticks a little into the block member 61.

The liquid dispensing container of this invention has the above-mentioned constructions. That is, the first mode of a liquid dispensing container for dispensing liquid from the liquid storage chamber through the dispensing port has a feature that an elastic member which is normally closed but is opened by the pressure of the liquid is arranged at the dispensing port, and the opened part of the elastic member opened by the liquid pressure is used as the dispensing port. The second mode of a liquid dispensing container for dispensing liquid from the liquid storage chamber through the dispensing port has a feature that the thin plate member with elasticity is so fixed at the dispensing port of the nozzle as to be surrounded by the nozzle body, and the nonfixed portion of the thin plate member is made to serve as the dispensing port. The third mode of a liquid dispensing container that discharges liquid from the liquid storage chamber through the dispensing port has a feature that the filmlike member is fixed at the dispensing port with a part thereof unfixed, and the unfixed part of the filmlike member is made to serve as the dispensing port. Further, the fourth mode of a liquid dispensing container that dispenses liquid from the liquid storage chamber through the dispensing port has a feature that the elastic member is so secured to the dispensing port of the nozzle as to be surrounded by the nozzle body, the elastic member has a liquid passage that is normally closed, and the front end portion of the liquid passage is made to serve as the dispensing port.

With the above constructions, it is possible to prevent air or external foreign substance from entering the dispensing port and the interior of the container body, prevent the liquid from drying, and keep the liquid sanitary.

We claim:

1. A liquid dispensing container comprising: a container body for storing a liquid to be dispensed; a nozzle member connected to the container body, the nozzle member having a nozzle opening of constant unvarying size for dispensing liquid from the container, and a liquid passage communicating the interior of the container body with the nozzle opening; and an elastically deformable member mounted within the nozzle member and extending into the liquid passage and having an end part which terminates at or immediately adjacent to the nozzle opening, the end part of the elastically deformable member normally closing the liquid passage to prevent the flow of liquid out the nozzle opening and being elastically deformable in response to an increase in pressure of the liquid to open the liquid passage to permit the liquid to flow out the nozzle opening.

2. A liquid dispensing container according to claim 1; wherein the elastically deformable member comprises an elastically deflectable thin plate member mounted in the nozzle member so as to normally close the liquid passage and being elastically deflected in response to an increase in pressure of the liquid to open the liquid passage.

3. A liquid dispensing container according to claim 2; including means disposed in the nozzle member for limiting the extent of elastic deflection of the thin plate member.

4. A liquid dispensing container according to claim 1; including means for releasably sealing a gap between the thin plate member and the nozzle opening.

5. A liquid dispensing container according to claim 4; wherein the means for releasably sealing comprises an adhesive tape.

6. A liquid dispensing container according to claim 4; wherein the means for releasably sealing comprises a liquid sealant.

7. A liquid dispensing container according to claim 1; wherein the elastically deformable member comprises an elastically deformable filmlike member.

8. A liquid dispensing container according to claim 7; wherein the filmlike member comprises a multi-layer structure.

9. A liquid dispensing container according to claim 7; wherein the filmlike member is fixed to the nozzle member so as to overlie and normally close the nozzle opening, a portion of the filmlike member not being fixed to the nozzle member and being free to undergo elastic deformation in response to an increase in pressure of the liquid to thereby open the nozzle opening.

10. A liquid dispensing container according to claim 9; including a support member connected to a face of the filmlike member opposite the face thereof which overlies the nozzle opening, the support member having a recess therein to accommodate elastic deformation of the filmlike member.

11. A liquid dispensing container according to claim 1; wherein the elastically deformable member comprises an elastically expandable tubular member defining a portion of the liquid passage and having an end part inserted into the nozzle opening, the tubular member end part being normally collapsed to prevent liquid flow therethrough and being elastically expandable in response to an increase in pressure of the liquid to thereby permit the liquid to flow out the nozzle opening.

12. A liquid dispensing container according to claim 11; wherein the nozzle member has a space in the region of the nozzle opening effective to accommodate expansion of the tubular member.

13. A liquid dispensing container according to claim 1; wherein the elastically deformable member comprises an elastically deformable block member having a slit extending therethrough, the slit defining a portion of the liquid passage and having one end thereof terminating at and opening into the nozzle opening, the block member normally closing the slit to prevent liquid flow therethrough and being elastically deformable in response to an increase in pressure of the liquid to open the slit to permit liquid to flow therethrough and out the nozzle opening.

14. A liquid dispensing container according to claim 13; wherein the block member is composed of silicone.

15. A liquid dispensing container according to claim 1; wherein the container body is composed of material sufficiently flexible to permit squeezing of the container body to increase the pressure of the liquid to effect opening of the liquid passage and flow of the liquid out the nozzle opening.

16. A liquid dispensing container according to claim 15; wherein the liquid dispensing container is free of any valve mechanism and relies solely on the squeezing of the container body to elastically deform the elastically deformable member to open the liquid passage.

17. A liquid dispensing container according to claim 1; wherein the nozzle member is mounted to undergo depressing movement relative to the container body to increase the pressure of the liquid in the liquid passage and thereby elastically deform the elastically deformable member to open the liquid passage.

18. A liquid dispensing container according to claim 17; wherein the elastically deformable member comprises an elastically deflectable thin plate member mounted in the nozzle member so as to normally close the liquid passage and being elastically deflected in response to an increase in pressure of the liquid to open the liquid passage.

19. A liquid dispensing container according to claim 18; including means disposed in the nozzle member for limiting the extent of elastic deflection of the thin plate member.

20. A liquid dispensing container according to claim 17; wherein the elastically deformable member comprises an elastically deformable filmlike member.

21. A liquid dispensing container according to claim 20; wherein the filmlike member is fixed to the nozzle member so as to overlie and normally close the nozzle opening, a portion of the filmlike member not being fixed to the nozzle member and being free to undergo elastic deformation in response to an increase in pressure of the liquid to thereby open the nozzle opening.

22. A liquid dispensing container according to claim 21; including a support member connected to a face of the filmlike member opposite the face thereof which overlies the nozzle opening, the support member having a recess therein to accommodate elastic deformation of the filmlike member.

23. A liquid dispensing container according to claim 17; wherein the elastically deformable member comprises an elastically expandable tubular member defining a portion of the liquid passage and having an end part inserted into the nozzle opening, the tubular member end part being normally collapsed to prevent liquid flow therethrough and being elastically expandable in response to an increase in pressure of the liquid to thereby permit the liquid to flow out the nozzle opening.

24. A liquid dispensing container according to claim 23; wherein the nozzle member has a space in the region of the nozzle opening effective to accommodate expansion of the tubular member.

25. A liquid dispensing container according to claim 17; wherein the elastically deformable member comprises an elastically deformable block member having a slit extending therethrough, the slit defining a portion of the liquid passage and having one end thereof terminating at and opening into the nozzle opening, the block member normally closing the slit to prevent liquid flow therethrough and being elastically deformable in response to an increase in pressure of the liquid to open the slit to permit liquid to flow therethrough and out the nozzle opening.

26. A liquid dispensing container comprising:

a container body having therein a liquid storage chamber;

a nozzle member connected to the container body and having a nozzle opening of constant unvarying size for dispensing liquid from the liquid storage chamber; and an elastic member disposed in the nozzle member, the elastic member being normally closed and being opened to form an opened part by the pressure of the liquid when the liquid pressure is increased;

wherein the opened part of the elastic member is positioned closely adjacent to the nozzle opening so that the opened part of the elastic member serves as a dispensing port for permitting the liquid to flow out of the nozzle opening.

27. A liquid dispensing container comprising:

a container body having therein a liquid storage chamber;

a nozzle member connected to the container body and having a nozzle opening of constant unvarying size for dispensing liquid from the liquid storage chamber; and an elastic thin plate member disposed in the nozzle member, the elastic thin plate member overlying and normally closing the nozzle opening and being surrounded by a wall portion of the nozzle member and being fixed at a portion thereof to the nozzle member;

wherein the nonfixed portion of the elastic thin plate member is opened by the pressure of the liquid when the liquid pressure is increased and serves as a dispensing port for permitting the liquid to flow out the nozzle opening.

28. A liquid dispensing container comprising:

a container body having therein a liquid storage chamber;

a nozzle member connected to the container body and having a nozzle opening for dispensing liquid from the liquid storage chamber; and an elastic filmlike member disposed in the nozzle member, the elastic filmlike member overlying and normally closing the nozzle opening and being fixed at a portion thereof to the nozzle member;

wherein the nonfixed portion of the elastic filmlike member is opened by the pressure of the liquid when the liquid pressure is increased and serves as a dispensing port for permitting the liquid to flow out the nozzle opening.

29. A liquid dispensing container comprising:

a container body having therein a liquid storage chamber;

a nozzle member connected to the container body and having a nozzle opening for dispensing liquid from the liquid storage chamber; and an elastic tubular member disposed in the nozzle member in communication with the liquid storage chamber and with a front end of the elastic tubular member extending into the nozzle opening;

wherein the front end of the elastic tubular member is normally closed and is opened by the pressure of the liquid when the liquid pressure is increased so that the front end thereof serves as a dispensing port for permitting the liquid to flow out of the nozzle opening.

* * * * *